US007314357B2

(12) United States Patent
Gopinathan et al.

(10) Patent No.: US 7,314,357 B2
(45) Date of Patent: Jan. 1, 2008

(54) SEAL MEMBER FOR SCROLL COMPRESSORS

(75) Inventors: Anil Gopinathan, Clinton, MI (US); Frederick F. Fox, Hudson, MI (US)

(73) Assignee: Tecumseh Products Company, Tecumseh, MI (US)

( * ) Notice: Subject to any disclaimer, the term of this patent is extended or adjusted under 35 U.S.C. 154(b) by 124 days.

(21) Appl. No.: 11/120,273

(22) Filed: May 2, 2005

(65) Prior Publication Data

US 2006/0245968 A1 Nov. 2, 2006

(51) Int. Cl.
*F03C 2/00* (2006.01)
*F04C 18/00* (2006.01)

(52) U.S. Cl. ..... 418/55.4; 418/55.1; 418/104; 418/149

(58) Field of Classification Search ..... 418/55.1–55.6, 418/57, 104, 149
See application file for complete search history.

(56) References Cited

U.S. PATENT DOCUMENTS 3,874,827 A 4/1975 Young
3,924,977 A 12/1975 McCullough
4,314,796 A 2/1982 Terauchi
4,332,535 A 6/1982 Terauchi et al.
4,389,171 A 6/1983 Eber et al.
4,552,518 A 11/1985 Utter
4,571,163 A * 2/1986 Sakamoto et al. ..... 418/55.1
4,611,830 A 9/1986 von Ahrens
4,696,629 A 9/1987 Shiibayashi et al.
4,696,630 A 9/1987 Sakata et al.
4,767,293 A 8/1988 Caillat et al.
4,904,165 A 2/1990 Fraser, Jr. et al.
4,958,993 A 9/1990 Fujio
RE33,652 E 7/1991 Yamamura et al.
5,049,044 A 9/1991 Hirano
5,076,067 A 12/1991 Prenger et al.
5,141,420 A 8/1992 Nambiar
5,169,294 A 12/1992 Barito
5,176,506 A 1/1993 Siebel
5,178,526 A 1/1993 Galante et al.
5,197,868 A 3/1993 Caillat et al.
5,242,284 A 9/1993 Mitunaga et al.
5,248,244 A 9/1993 Ho et al.
5,320,506 A 6/1994 Fogt
5,366,357 A * 11/1994 Fukanuma et al. ..... 418/55.1
5,427,511 A 6/1995 Caillat et al.
5,474,433 A 12/1995 Chang et al.

(Continued)

FOREIGN PATENT DOCUMENTS

EP 0 480 560 9/1996

(Continued)

*Primary Examiner*—Theresa Trieu
(74) *Attorney, Agent, or Firm*—Baker & Daniels LLP

(57) ABSTRACT

A scroll compressor having a housing with a motor-compressor unit disposed therein. The motor-compressor unit includes a crankcase, stator, rotor, and drive shaft assembly. The motor-compressor unit further includes a fixed scroll member and an orbiting scroll member. The scroll compressor has a separator plate disposed within the housing and secured to the fixed scroll member by a plurality of fasteners. A seal member is provided between the separator plate and the fixed scroll member and is disposed radially outwardly of at least one of the fasteners. In an exemplary embodiment, the seal member is an O-ring.

19 Claims, 5 Drawing Sheets

U.S. PATENT DOCUMENTS

| | | | | |
|---|---|---|---|---|
| 5,494,422 | A | | 2/1996 | Ukai et al. |
| 5,527,158 | A | | 6/1996 | Ramsey et al. |
| 5,540,571 | A | * | 7/1996 | Yoshida et al. ..... 418/55.1 |
| 5,562,434 | A | | 10/1996 | Makino et al. |
| 5,588,819 | A | | 12/1996 | Wallis |
| 5,611,674 | A | | 3/1997 | Bass et al. |
| 5,674,061 | A | | 10/1997 | Motegi et al. |
| 5,707,210 | A | | 1/1998 | Ramsey et al. |
| 5,863,190 | A | | 1/1999 | Yamamoto et al. |
| 6,017,203 | A | | 1/2000 | Sugawa et al. |
| 6,027,321 | A | | 2/2000 | Shim et al. |
| 6,056,524 | A | | 5/2000 | Williams et al. |
| 6,095,765 | A | | 8/2000 | Khalifa |
| 6,106,254 | A | | 8/2000 | Hirooka et al. |
| 6,190,138 | B1 | | 2/2001 | Hugenroth et al. |
| 6,203,298 | B1 | | 3/2001 | Scarfone et al. |
| 6,273,616 | B1 | | 8/2001 | Pflug |
| 6,419,457 | B1 | | 7/2002 | Seibel et al. |
| 6,439,775 | B1 | | 8/2002 | Ito |
| 6,478,550 | B2 | | 11/2002 | Matsuba et al. |
| 6,494,688 | B1 | | 12/2002 | Barito et al. |
| 6,679,683 | B2 | * | 1/2004 | Seibel et al. ..... 418/57 |
| 6,687,992 | B2 | * | 2/2004 | Quesada et al. ..... 29/888.022 |
| 2004/0047754 | A1 | | 3/2004 | Gopinathan |

FOREIGN PATENT DOCUMENTS

| | | | | |
|---|---|---|---|---|
| EP | 0 655 555 | | | 6/1998 |
| GB | 2 154 665 | | | 9/1985 |
| GB | 2 159 884 | | | 12/1985 |
| JP | 54-124310 | | | 9/1979 |
| JP | 55-46046 | | | 3/1980 |
| JP | 55060687 | A | * | 5/1980 |
| JP | 58-170877 | | | 10/1983 |
| JP | 59-41035 | | | 10/1984 |
| JP | 60-73081 | | | 4/1985 |
| JP | 60-95194 | | | 6/1985 |
| KR | 2001035762 | A | * | 5/2001 |

* cited by examiner

SEAL MEMBER FOR SCROLL COMPRESSORS

BACKGROUND OF THE INVENTION

1. Field of the Invention

The present invention relates to scroll machines, and in particular, to scroll compressors.

2. Description of the Related Art

Referring to FIGS. 1-4, a known scroll compressor 10 is shown, which includes main housing 12, bottom cap 14 with base 16 secured to the lower end of housing 12, and a separator plate 18 and top cap 20 each secured to the upper end of housing 12 by a welding, brazing, or other suitable operation to define an enclosed hermetic housing in which the motor-compressor unit 22 of compressor 10 is disposed. Motor-compressor unit 22 generally includes a first, fixed scroll 24, a second, orbiting scroll 26, crankcase 28, drive shaft 30, stator 32, rotor 34, and outboard bearing assembly 36. Separator plate 18 is secured around its perimeter to the interior of housing 12, such as by welding, and divides the interior of the housing 12 into a suction chamber 38 in fluid communication with suction port 40 in housing 12, and discharge chamber 42 in fluid communication with discharge port 44 in top cap 20. Scroll compressor 10 is similar to the scroll compressor discussed in detail in U.S. Patent Application Publication No. US 2004/0047754 A1, application Ser. No. 10/235,214, entitled OIL SHIELD AS PART OF CRANKCASE FOR A SCROLL COMPRESSOR, filed on Sep. 5, 2002, assigned to the assignee of the present invention, the disclosure of which is expressly incorporated herein by reference.

Fixed scroll 24 is secured to separator plate 18, such as by a plurality of bolts 72 disposed radially outwardly of separator plate hole 19, and includes outer wall 46 extending from base plate 48, and an involute wrap 50 extending from base plate 48 and disposed inwardly of outer wall 46. Fixed scroll 24 further includes a plurality of mount flanges 52 spaced radially about the end of outer wall 46 opposite base plate 48, and a plurality of bolts (not shown) secure mount flanges 52 to crankcase 28. Crankcase 28 includes main bearing 54 in which the upper portion of drive shaft 30 is rotatably supported. Stator 32 is fixed within housing 12 and is connected to outboard bearing assembly 36 and crankcase 28 in a suitable manner. Drive shaft 30 is secured to rotor 34 in a suitable manner, and outboard bearing assembly 36 includes outboard bearing 56 which supports a lower end of drive shaft 30. The upper portion of drive shaft 30 includes an eccentric end mounted within annular hub 58 extending downwardly from base plate 60 of orbiting scroll 26. Orbiting scroll 26 additionally includes an involute wrap 62 extending upwardly from base plate 60 thereof, which is in meshing relationship with wrap 50 of fixed scroll 24. Oldham coupling 64 is operatively coupled between orbiting scroll 26 and crankcase 28 to prevent rotation of orbiting scroll 26, as is known.

Additionally, fixed scroll 24 includes discharge outlet 68 in base plate 48. Discharge outlet 68 may be substantially centrally located within fixed scroll 24 and may be aligned with separator plate hole 19 of separator plate 18.

In operation, electrical energization of stator 32 rotatably drives rotor 34 and drive shaft 30 to move orbiting scroll 26 in an orbiting manner with respect to fixed scroll 24. A working fluid at suction pressure is drawn from suction chamber 38 into a suction inlet 66 of fixed scroll 24, and is compressed within the plurality of variable volume, working pockets or compression chambers 55 which are defined between wraps 50 and 62 of fixed and orbiting scrolls 24 and 26, respectively, as orbiting scroll 26 rotates in a known manner. The compressed working fluid is then discharged through discharge outlet 68 in base plate 48 of fixed scroll 24, through discharge check valve assembly 70, and through separator plate hole 19 aligned with discharge outlet 68 into discharge chamber 42 at a discharge pressure. The discharge pressure working fluid exits compressor 10 through discharge port 44 to enter components of a refrigeration system (not shown).

Referring to FIGS. 2-4, gasket 74 ideally prevents potential leakage of discharge pressure working fluid from exiting discharge chamber 42 and returning to suction chamber 38, such as via a path denoted by Arrow C, shown in FIG. 4. However, a minimal gap may exist between separator plate 18 and gasket 74, or alternatively between fixed scroll 24 and gasket 74, which may permit discharge pressure working fluid to escape to suction chamber 38. Discharge pressure working fluid potentially may also leak around bolts 72 in a direction generally denoted by Arrow A and return to suction chamber 38 via the minimal gap denoted by Arrow C between separator plate 18 and gasket 74, or alternatively between fixed scroll 24 and gasket 74. Additionally, discharge pressure working fluid potentially may enter the gap denoted by Arrow C between separator plate 18 and gasket 74, or alternatively between fixed scroll 24 and gasket 74, via a path through separator plate hole 19 denoted by Arrow B. Once discharge pressure working fluid enters the gap denoted by Arrow C, the working fluid may enter suction chamber 38 in the direction generally denoted by Arrow D.

Additionally, internal pressure relief valve (IPRV) 76 is disposed in and threaded into separator plate 18, as shown in FIG. 3. IPRV 76 allows discharge pressure working fluid to be vented from discharge chamber 42 to suction chamber 38 in the event of overpressurization. IPRV 76 is accommodated in a recess formed near the outer periphery of fixed scroll 24. Consequently, gasket 74, which is designed to seal fixed scroll 24 and separator plate 18, is notched to a reduced width to clear IPRV 76. Therefore, the robustness of gasket 74 is undermined in the area around IPRV 76.

The above-described potential leak paths potentially reduce the efficiency of scroll compressor 10, thereby lowering productivity of the refrigeration system as a whole.

What is needed is a scroll compressor which is an improvement over the foregoing.

SUMMARY OF THE INVENTION

The present invention provides a scroll compressor having a housing with a motor-compressor unit disposed therein. The motor-compressor unit includes a crankcase, stator, rotor, and drive shaft assembly. The motor-compressor unit further includes a fixed scroll member and an orbiting scroll member. The scroll compressor has a separator plate disposed within the housing and secured to the fixed scroll member by a plurality of fasteners. A seal member is provided between the separator plate and the fixed scroll member and is disposed radially outwardly of at least one of the fasteners. In an exemplary embodiment, the seal member is an O-ring.

An advantage of the present invention is the complete prevention of discharge pressure working fluid leakage from a discharge chamber to a suction chamber of the scroll compressor, thereby enhancing productivity of the entire refrigeration system.

In one form thereof, the present invention provides a scroll compressor including a housing; a motor-compressor unit disposed within the housing, including a crankcase and a stator, rotor, and drive shaft assembly, the drive shaft rotatably supported by the crankcase, the motor-compressor unit further including a first scroll member fixed with respect to the housing and defining perpendicular axial and radial directions, the first scroll member including a base wall and a first wrap extending from the base wall; and a second scroll member coupled to the drive shaft for orbital movement, the second scroll member including a second wrap intermeshed with the first wrap; a separator plate disposed within the housing and secured to the first scroll member by a plurality of fasteners; and a seal member between the separator plate and the first scroll member, the seal member disposed radially outwardly of at least one of the fasteners.

In another form thereof, the present invention provides a scroll compressor including a housing; a motor-compressor unit disposed within the housing, including a crankcase and a stator, rotor, and drive shaft assembly, the drive shaft rotatably supported by the crankcase, the motor-compressor unit further including a first scroll member fixed with respect to the housing and defining perpendicular axial and radial directions, the first scroll member including a base wall having a discharge outlet located substantially centrally therein, and a first wrap extending from the base wall; and a second scroll member coupled to the drive shaft for orbital movement, the second scroll member including a second wrap intermeshed with the first wrap; a separator plate disposed within the housing and including an opening aligned with the discharge outlet, the separator plate secured to the first scroll member by a plurality of fasteners disposed radially outwardly of the opening; and a continuous seal member captured between the separator plate and the first scroll member, the seal member disposed radially outwardly of the fasteners.

In a further form thereof, the present invention provides a scroll compressor including a housing; a motor-compressor unit disposed within the housing including a crankcase; a stator, rotor, and drive shaft assembly, the drive shaft rotatably supported by the crankcase; a first scroll member fixed with respect to the housing and defining perpendicular axial and radial directions, the first scroll member including a base wall and a first wrap extending from the base wall; and a second scroll member coupled to the drive shaft for orbital movement, the second scroll member including a second wrap intermeshed with the first wrap; a separator plate disposed within the housing and dividing the housing into a suction chamber and a discharge chamber, the separator plate secured to the first scroll member by a plurality of fasteners; and sealing means between the separator plate and the first scroll member to prevent passage of a working fluid therebetween.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 5:
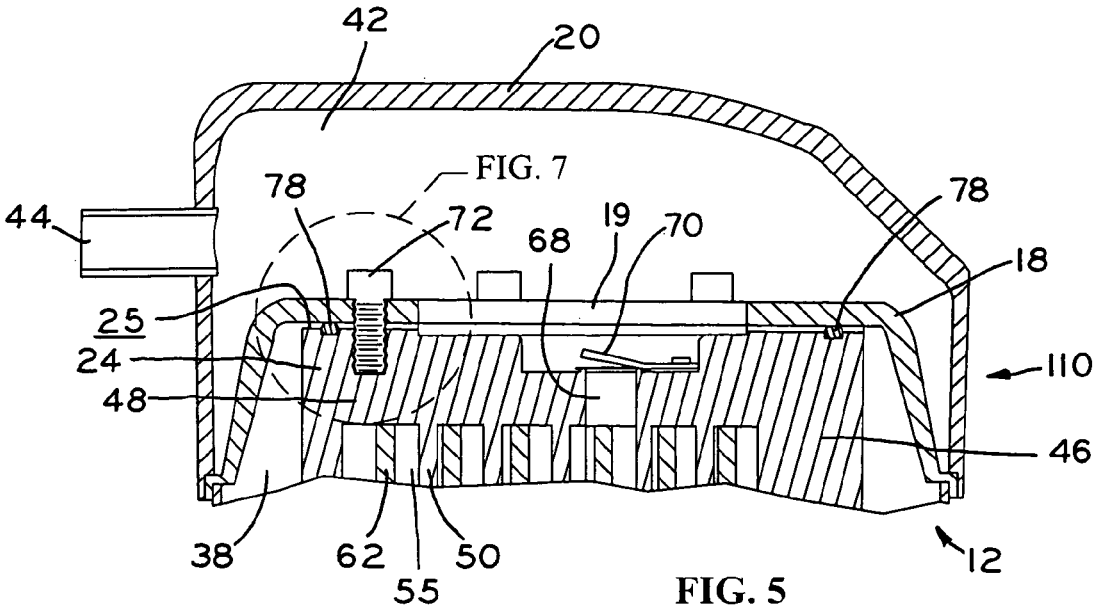
FIG. 5 is a fragmentary portion of FIG. 1, further illustrating a seal member in accordance with the present invention.

Referring to FIG. 5, scroll compressor 110 is shown in partial view, which includes main housing 12, bottom cap 14 with base 16 (FIG. 1) secured to the lower end of housing 12, and a separator plate 18 and top cap 20 each secured to the upper end of housing 12 by a welding, brazing, or other suitable operation to define an enclosed hermetic housing in which the motor-compressor unit 22 (FIG. 1) of compressor 110 is disposed. Except as described below, compressor 110 includes many features identical or substantially identical to those of scroll compressor 10 described above, and the same reference numerals are used in FIGS. 5-9 to denote identical or substantially identical features therebetween.

Scroll compressor 110 further includes a first, fixed scroll 24 and a second, orbiting scroll 26. Fixed scroll 24 is fixed with respect to housing 12 and defines perpendicular axial and radial directions. The axial direction of fixed scroll 24 is aligned with the central, longitudinal axis of housing 12. Separator plate 18 is secured around its perimeter to the interior of housing 12, such as by welding, and divides the interior of the housing 12 into a suction chamber 38 in fluid communication with suction port 40 (FIG. 1) in housing 12, and discharge chamber 42 in fluid communication with discharge port 44 in top cap 20.

Figure 1:
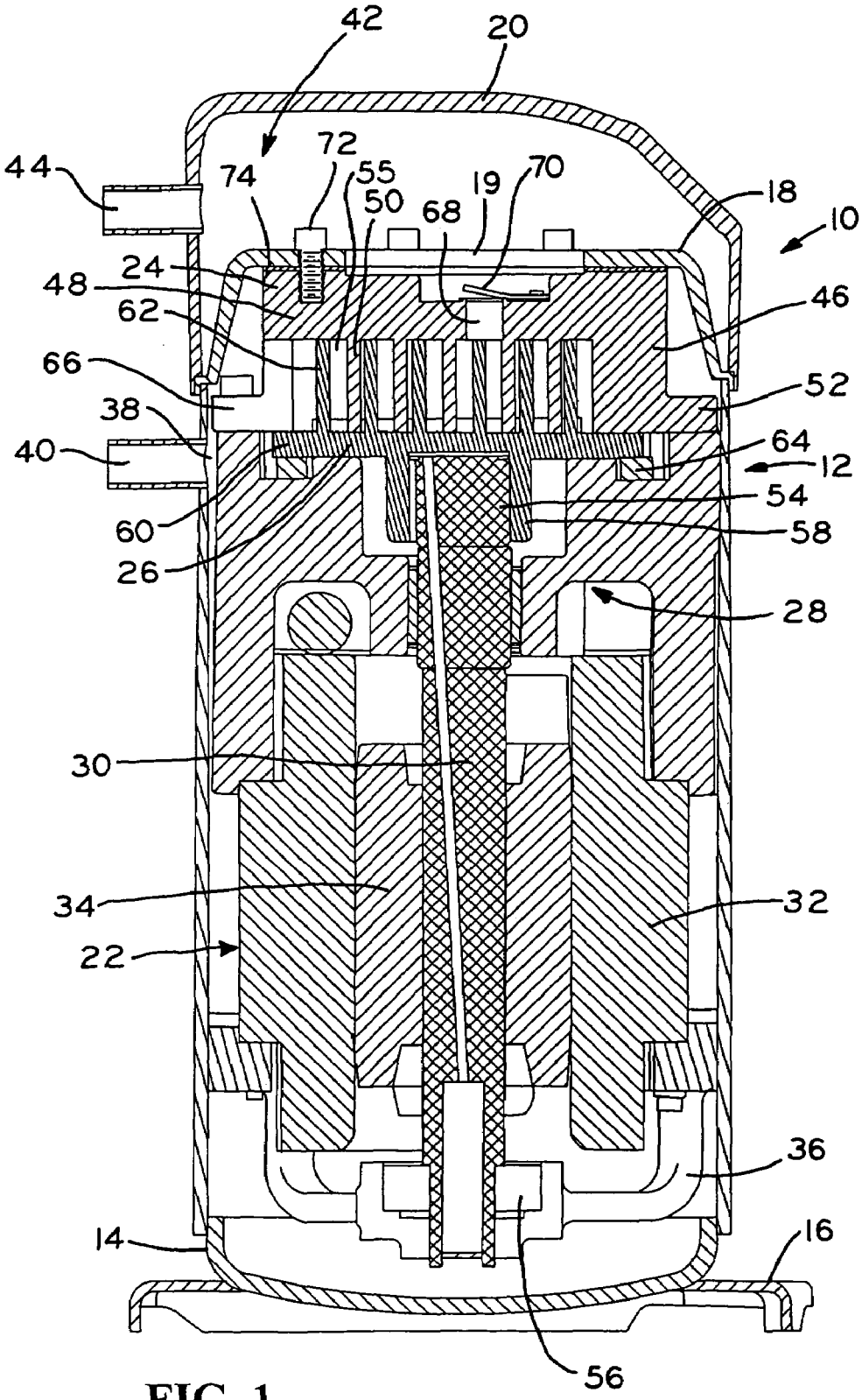
FIG. 1 PRIOR ART
FIG. 1 is a vertical sectional view through a known scroll compressor.
Figure 2:
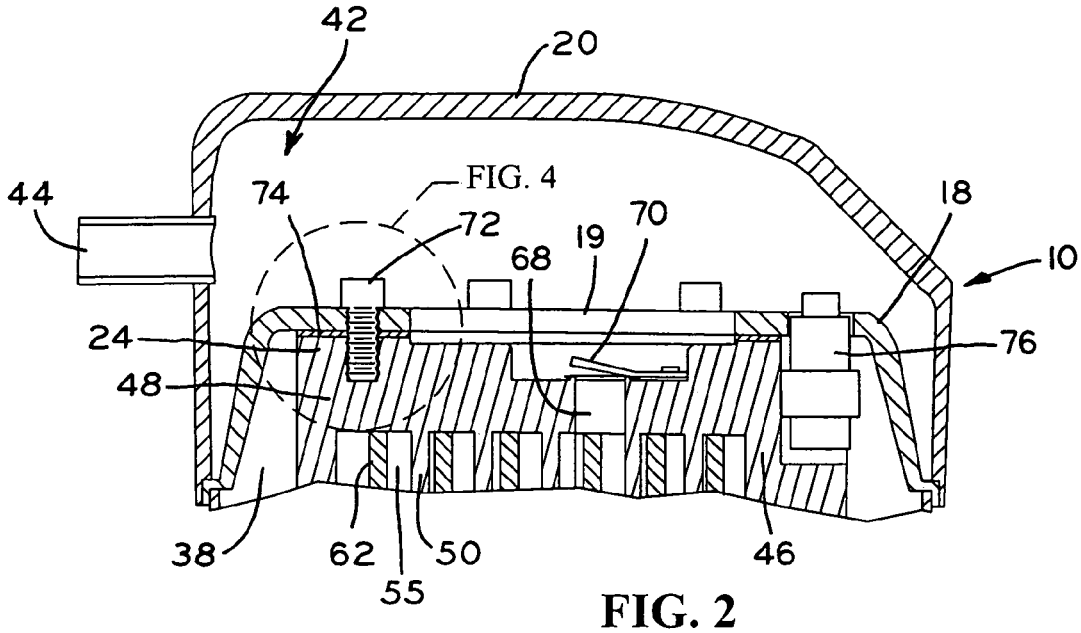
FIG. 2 PRIOR ART
FIG. 2 is a fragmentary portion of FIG. 1, further illustrating an internal pressure relief valve.
Figure 3:
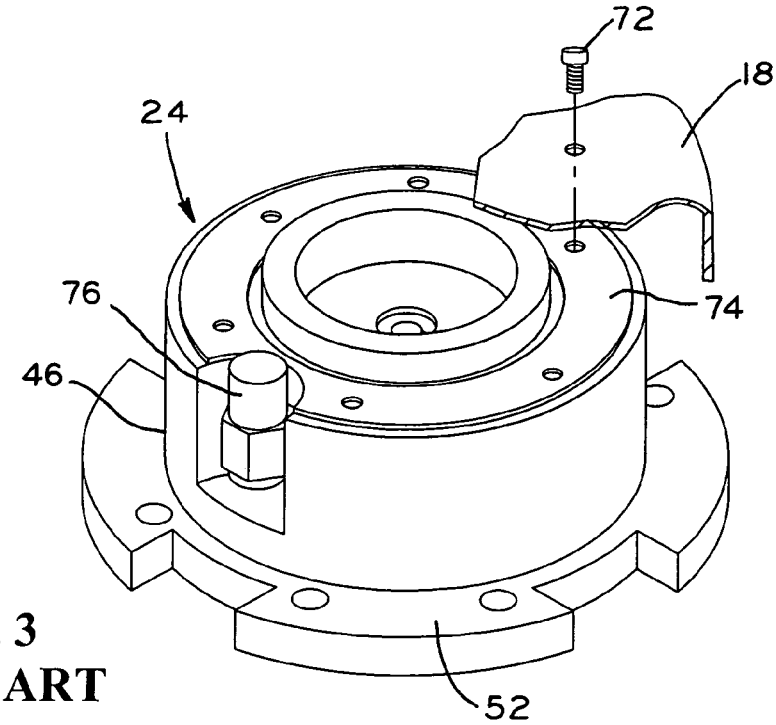
FIG. 3 PRIOR ART
FIG. 3 is a perspective view of a fixed scroll of the known scroll compressor of FIG. 1, further showing a fragmentary portion of the separator plate.
Figure 4:
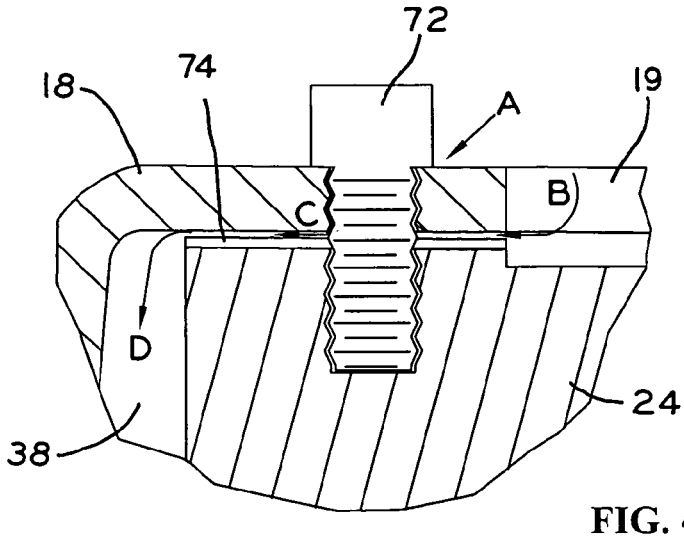
FIG. 4 PRIOR ART
FIG. 4 is a close-up view of a portion of FIG. 2.
Figure 6:
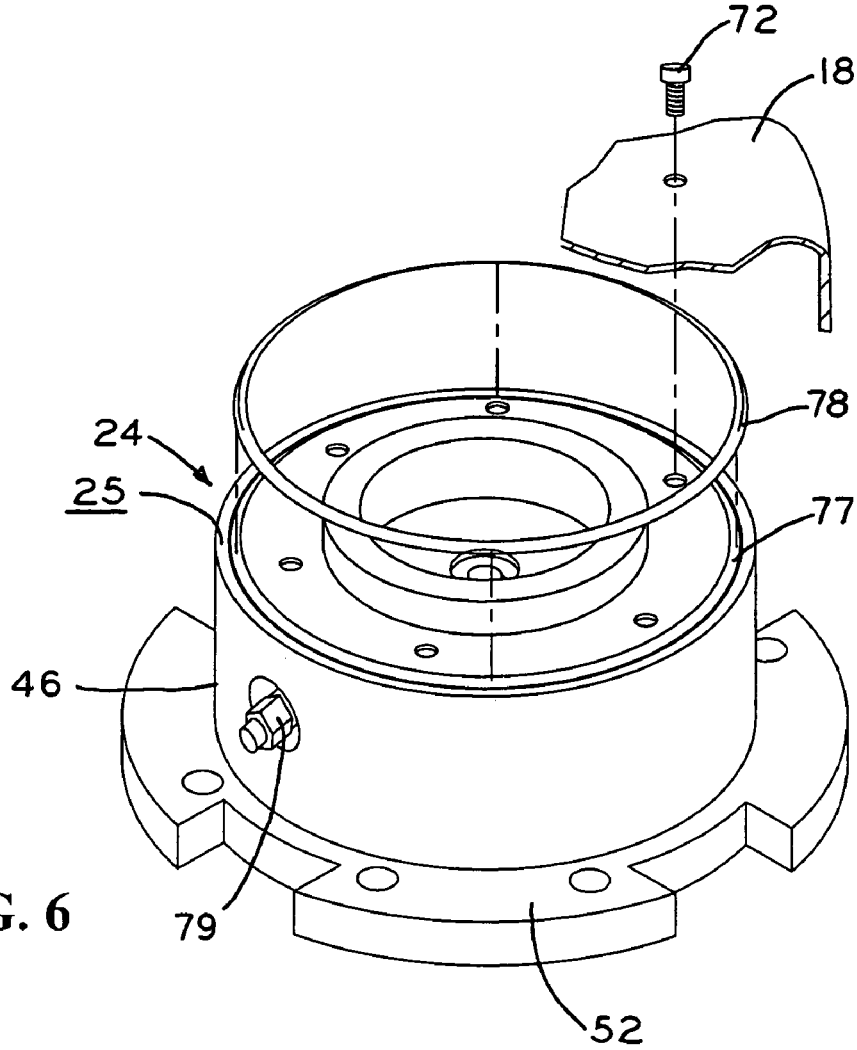
FIG. 6 is a perspective view of a fixed scroll of the scroll compressor of FIG. 5, further showing a fragmentary portion of the separator plate.

Referring now to FIGS. 5 and 6, fixed scroll 24 is secured to separator plate 18,. such as by a plurality of fasteners or bolts 72 extending in the axial direction, and includes outer wall 46 extending from base wall or plate 48, and an involute wrap 50 extending from base plate 48 and disposed inwardly of outer wall 46. Fixed scroll 24 further includes a plurality of mount flanges 52 (FIG. 1) spaced radially about the end of outer wall 46 opposite base plate 48, and a plurality of bolts secure mount flanges 52 to crankcase 28 (FIG. 1). Orbiting scroll 26 includes an involute wrap 62 extending upwardly from base plate 60 (FIG. 1) thereof, which is in meshing relationship with wrap 50 of fixed scroll 24. Oldham coupling 64 (FIG. 1) is operatively coupled between orbiting scroll 26 and crankcase 28 to prevent rotation of orbiting scroll 26, as is known.

The operation of scroll compressor 110 is substantially similar to that described above for scroll compressor 10 and is not described further herein.

Figure 7:
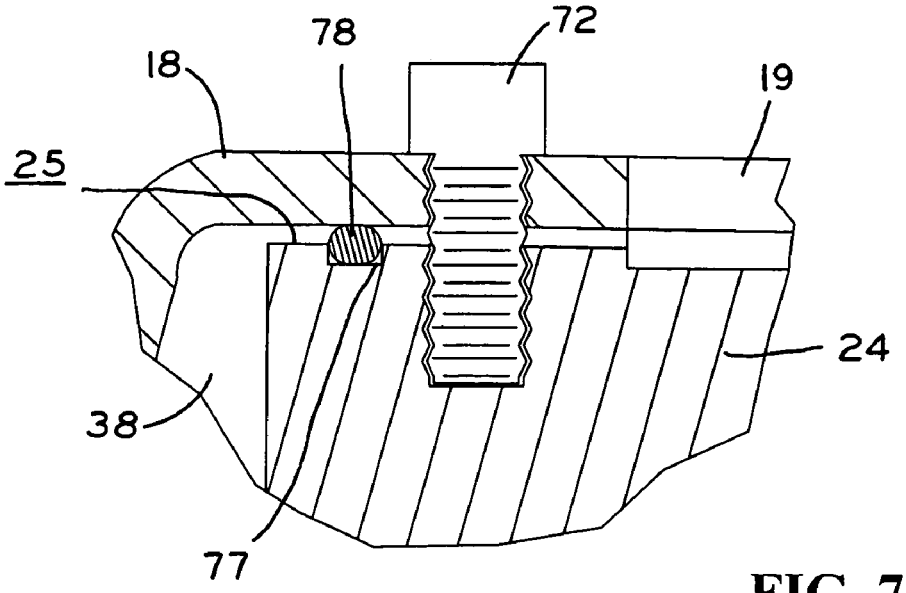
FIG. 7 is a close-up view of a portion of FIG. 5.

Referring now to FIG. 6, fixed scroll 24 includes annular groove 77 formed in top surface 25 thereof and located radially outwardly of fasteners 72. Groove 77 accommodates seal member or O-ring 78 and may take any cross-sectional shape including semi-circular, rectilinear (as shown in FIG. 7), or semi-oval shapes. Similarly, seal member 78 may be any shape such as a circular, oval, square, rectilinear, or irregular shape.. Seal member 78 preferably extends a distance above top surface 25 of fixed scroll 24 and is captured under compression between separator plate 18 and fixed scroll 24. More specifically, separator plate 18 compresses seal member 78 upon the torque of fasteners 72 when separator plate 18 is attached to fixed scroll 24 to form a fluidtight seal between separator plate 18 and fixed scroll 24. Seal member 78 may be continuous or, alternatively, may be broken into a plurality of separate components.

The fluidtight seal between separator plate 18 and fixed scroll 24 prevents leakage of discharge pressure working fluid from discharge chamber 42 into suction chamber 38. Advantageously, the fluidtight seal is radially outside the perimeter of fasteners 72 such that, even if leakage were to occur around fasteners 72, seal member 78 would prevent the discharge pressure working fluid from entering suction chamber 38.

In an alternative embodiment (not shown), separator plate 18 may include an annular groove located in a bottom surface thereof to accommodate seal member or O-ring 78. Seal member 78 would preferably extend a distance below the bottom surface of separator plate 18 and be captured under compression between separator plate 18 and fixed scroll 24 to form a fluidtight seal between separator plate 18 and fixed scroll 24.

In another alternative embodiment (not shown), both separator plate 18 and fixed scroll 24 may each include annular grooves to accommodate seal member or O-ring 78. Seal member 78 would be captured under compression between separator plate 18 and fixed scroll 24. Separator plate 18 and fixed scroll 24 compress seal member 78 upon torque of fasteners 72 when separator plate 18 is attached to fixed scroll 24 to form a fluidtight seal between separator plate 18 and fixed scroll 24.

Figure 8:
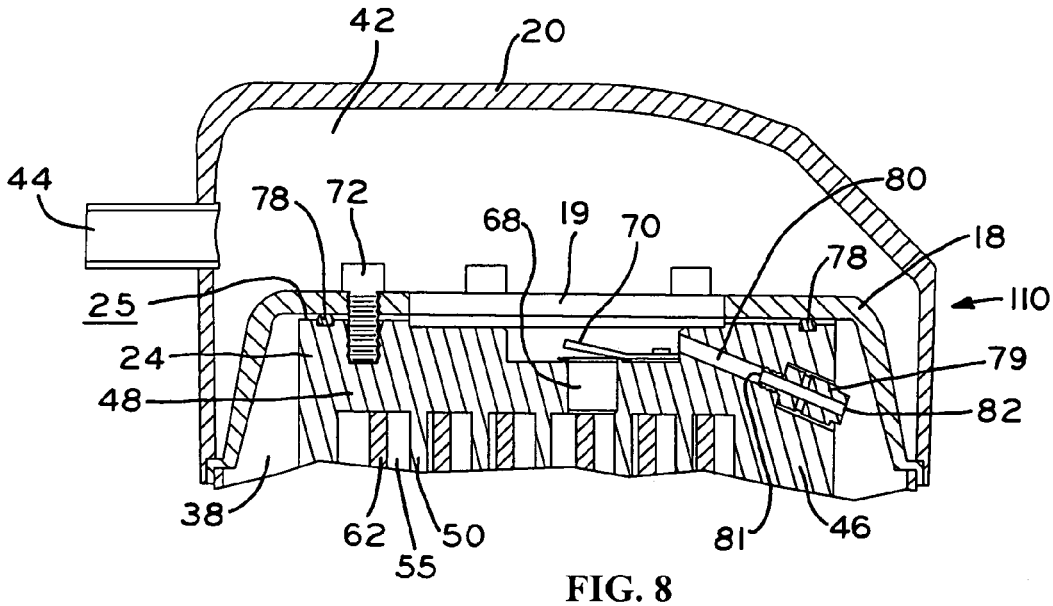
FIG. 8 is a fragmentary portion of FIG. 1, further illustrating a seal member and an internal pressure relief valve in accordance with the present invention.

Referring now to FIG. 8, scroll compressor 110 is provided with internal pressure relief valve (IPRV) 79 which allows discharge pressure working fluid to be vented from discharge chamber 42 to suction chamber 38 in the event of overpressurization. IPRV 79 selectively fluidly communicates discharge chamber 42 with suction chamber 38. IPRV 79 is threaded within bore 80 formed in fixed scroll 24 at an acute angle relative to the central longitudinal axis of fixed scroll 24. Inlet end 81 of IPRV 79 is threaded into a portion of bore 80 and is thus advantageously located inside the sealed space defined by seal member 78. Inlet end 81 of IPRV 79 is in fluid communication with discharge chamber 42. Outlet end 82 of IPRV 79 is in fluid communication with suction chamber 38. Therefore, IPRV 79 may be subassembled into fixed scroll 24, and the fluidtight seal between fixed scroll 24 and separator plate 18 provided by seal member 78 is unaffected.

Figure 9:
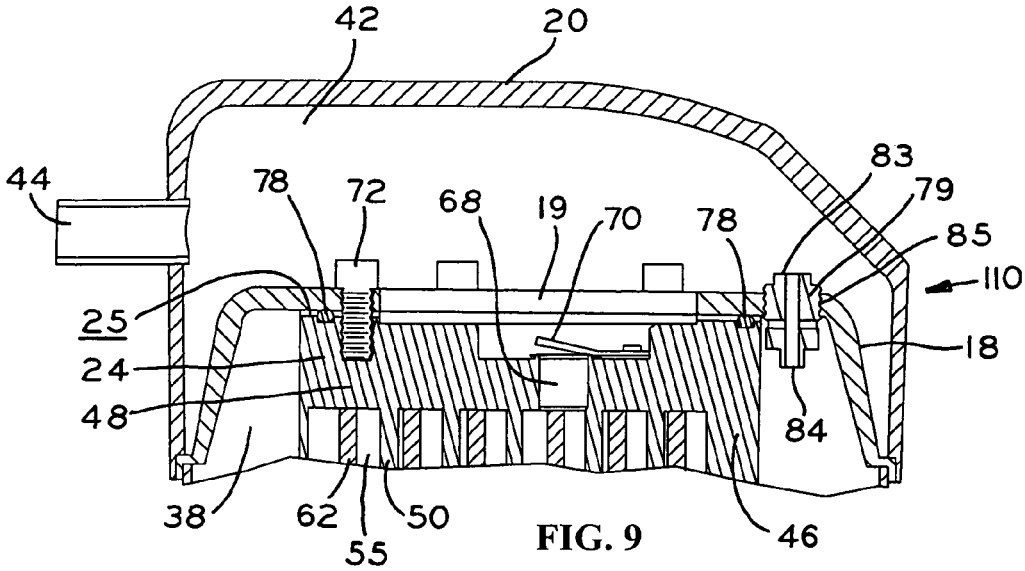
FIG. 9 is a fragmentary portion of FIG. 1, further illustrating a seal member and an alternative placement of an internal pressure relief valve in accordance with the present invention.

Referring now to FIG. 9, scroll compressor 110 is provided with an alternate placement of IPRV 79. IPRV 79 is disposed in bore 85 formed in separator plate 18 radially outwardly of fixed scroll 24. Inlet end 83 of IPRV 79 is threaded into bore 85 and is in fluid communication with discharge chamber 42. Outlet end 84 of IPRV 79 is in fluid communication with suction chamber 38. By locating IPRV 79 radially outwardly of fixed scroll 24, the fluidtight seal between fixed scroll 24 and separator plate 18 provided by seal member 78 is unaffected.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll compressor, comprising:

a housing;

a motor-compressor unit disposed within said housing, including a crankcase and a stator, rotor, and drive shaft assembly, said drive shaft rotatably supported by said crankcase, said motor-compressor unit further comprising:

a first scroll member fixed with respect to said housing and defining perpendicular axial and radial directions, said first scroll member including a base wall and a first wrap extending from said base wall; and a second scroll member coupled to said drive shaft for orbital movement, said second scroll member including a second wrap intermeshed with said first wrap;

a separator plate disposed within said housing and secured to said first scroll member by a plurality of fasteners; and a seal member between said separator plate and said first scroll member, said seal member disposed radially outwardly of at least one of said fasteners, said seal member captured under compression in the axial direction between said separator plate and said first scroll member.

2. The scroll compressor of claim 1, wherein said seal member comprises an O-ring, said O-ring disposed within an annular groove provided within at least one of said first scroll member and said separator plate.

3. The scroll compressor of claim 1, wherein said separator plate is secured to said base wall of said first scroll member by said fasteners, said fasteners extending in the axial direction.

4. The scroll compressor of claim 1, wherein said first scroll member further includes a discharge outlet, and said separator plate further includes an opening, said opening aligned with said discharge outlet.

5. The scroll compressor of claim 1, wherein said housing includes a suction port and a discharge port, said separator plate dividing an interior of said housing into a suction chamber in fluid communication with said suction port and a discharge chamber in fluid communication with said discharge port.

6. The scroll compressor of claim 5, further comprising a pressure relief valve associated with at least one of said separator plate and said fixed scroll member, said pressure relief valve selectively fluidly communicating said discharge chamber with said suction chamber.

7. The scroll compressor of claim 5, wherein said motor-compressor unit is disposed within said suction chamber.

8. The scroll compressor of claim 1, wherein said separator plate includes an outer periphery which is secured around its entire extent to an interior surface of said housing.

9. A scroll compressor, comprising:

a housing;

a motor-compressor unit disposed within said housing, including a crankcase and a stator, rotor, and drive shaft assembly, said drive shaft rotatably supported by said crankcase, said motor-compressor unit further comprising:

a first scroll member fixed with respect to said housing and defining perpendicular axial and radial directions, said first scroll member including a base wall having a discharge outlet located substantially centrally therein, and a first wrap extending from said base wall; and a second scroll member coupled to said drive shaft for orbital movement, said second scroll member including a second wrap intermeshed with said first wrap;

a separator plate disposed within said housing and including an opening aligned with said discharge outlet, said separator plate secured to said first scroll member by a plurality of fasteners disposed radially outwardly of said opening; and a continuous seal member captured between said separator plate and said first scroll member, said seal member disposed radially outwardly of said fasteners, said seal member captured under compression in the axial direction between said separator plate and said first scroll member.

10. The scroll compressor of claim 9, wherein said seal member comprises an O-ring, said O-ring disposed within an annular groove provided within at least one of said first scroll member and said separator plate.

11. The scroll compressor of claim 9, wherein said housing includes a suction port and a discharge port, said separator plate dividing an interior of said housing into a suction chamber in fluid communication with said suction port and a discharge chamber in fluid communication with said discharge port.

12. The scroll compressor of claim 11, further comprising a pressure relief valve associated with at least one of said separator plate and said fixed scroll member, said pressure relief valve selectively fluidly communicating said discharge chamber with said suction chamber.

13. The scroll compressor of claim 11, wherein said motor-compressor unit is disposed within said suction chamber.

14. A scroll compressor, comprising:

a housing;

a motor-compressor unit disposed within said housing, comprising:

a crankcase;

a stator, rotor, and drive shaft assembly, said drive shaft rotatably supported by said crankcase;

a first scroll member fixed with respect to said housing and defining perpendicular axial and radial directions, said first scroll member including a base wall and a first wrap extending from said base wall; and a second scroll member coupled to said drive shaft for orbital movement, said second scroll member including a second wrap intermeshed with said first wrap;

a separator plate disposed within said housing and dividing said housing into a suction chamber and a discharge chamber, said separator plate secured to said first scroll member by a plurality of fasteners; and sealing means between said separator plate and said first scroll member to prevent passage of a working fluid therebetween, said sealing means captured under compression in the axial direction between said separator plate and said first scroll member.

15. The scroll compressor of claim 14, wherein said means for sealing comprises an O-ring.

16. The scroll compressor of claim 14, further comprising means for securing said separator plate to said first scroll member and compressing said means for sealing.

17. The scroll compressor of claim 14, further comprising means for radially retaining said means for sealing with respect to at least one of said first scroll member and said separator plate.

18. The scroll compressor of claim 14, further comprising pressure relief means for selectively permitting fluid communication between said discharge chamber and said suction chamber.

19. The scroll compressor of claim 14, wherein said first scroll member further includes a discharge outlet and said separator plate further includes an opening, said opening aligned with said discharge outlet.

* * * * *